US008145395B2

(12) United States Patent
Degroot et al.

(10) Patent No.: US 8,145,395 B2
(45) Date of Patent: Mar. 27, 2012

(54) VEHICULAR STORED ENERGY PROCESSOR

(75) Inventors: Jarvis Degroot, Victoria (CA); Adrian Fengler, Aldergrove (CA); William Wilkinson, Surrey (CA)

(73) Assignee: Deere-Hitachi Speciality Products, Langley (CA)

( * ) Notice: Subject to any disclaimer, the term of this patent is extended or adjusted under 35 U.S.C. 154(b) by 0 days.

(21) Appl. No.: 12/919,253

(22) PCT Filed: May 30, 2008

(86) PCT No.: PCT/IB2008/001384

§ 371 (c)(1), (2), (4) Date: Jan. 21, 2011

(87) PCT Pub. No.: WO2009/144524

PCT Pub. Date: Dec. 3, 2009

(65) Prior Publication Data

US 2011/0196582 A1 Aug. 11, 2011

(51) Int. Cl.
*G06F 19/00* (2006.01)

(52) U.S. Cl. ..... 701/50; 56/2; 56/6; 56/10.8; 56/11.9; 56/13.9; 144/4.1; 144/34.1; 144/34.5; 172/456

(58) Field of Classification Search ..... 701/50; 56/2, 6, 10.8, 11.9, 13.6, 15.6, 15.9, 14.4, 56/14.9, 17.1, 208, 221, 228, 500; 144/4.1, 144/34.1, 34.5; 280/111, 119; 460/492; 172/456

See application file for complete search history.

(56) References Cited

U.S. PATENT DOCUMENTS

| | | | | |
|---|---|---|---|---|
| 3,595,288 | A * | 7/1971 | Landers et al. | 144/338 |
| 3,661,051 | A | 5/1972 | Dunne | |
| 3,735,788 | A * | 5/1973 | Coughran, Jr. | 144/339 |
| 3,994,325 | A | 11/1976 | Cryder | |
| 4,153,086 | A * | 5/1979 | Oldenburg | 144/34.1 |
| 4,738,595 | A | 4/1988 | Gaiser | |
| 6,161,601 | A * | 12/2000 | Ostlie | 144/4.1 |
| 2007/0125447 | A1 | 6/2007 | Alfthan | |

OTHER PUBLICATIONS

Peter Nachtwey, Accumulators: The unsung heroes of hydraulic motion control, Hydraulics & Pneumatics, ISSN 0018-814X, Dec. 2006, Figure 1, pars. 3-6, 15, 18, pp. 34-36, Delta Computer Systems, Vancouver, Washington.

* cited by examiner

*Primary Examiner* — James P Trammell
*Assistant Examiner* — McDieunel Marc
(74) *Attorney, Agent, or Firm* — Taylor IP, P.C.

(57) ABSTRACT

A ground engaging work vehicle including a frame, a plurality of tractive elements, a movable extension, a hydraulic fluid using attachment, a hydraulic fluid pump and an accumulator. The plurality of tractive elements are coupled to the frame. The tractive elements engage the ground. The movable extension is connected to the frame. The hydraulic fluid using attachment is coupled to the movable extension. The hydraulic fluid pump is selectively fluidly coupled to the attachment. The accumulator is selectively fluidly coupled to the attachment dependent upon at least one fluid flow requirement of the attachment.

18 Claims, 3 Drawing Sheets

VEHICULAR STORED ENERGY PROCESSOR

FIELD OF THE INVENTION

The present invention relates to vehicles powered by engines, and more particularly to vehicles such as work machines having hydraulic fluid using attachments connected to the vehicle.

BACKGROUND OF THE INVENTION

The processing of tree trunks, also known as stems involve a harvester head for the delimbing and cutting of a tree. Often the head is utilized to grip an upright tree, cut the tree, after which the tree trunk is delimbed and cut into pieces of a fixed length by way of a sawing device. A harvester head with a feed roller is illustrated in U.S. Patent Publication No. US2007/0125447. A harvester head is particularly connected to the end of a working boom of a work machine. The harvester head includes delimbing portions having blades to delimb the stem as the stem is pulled through the harvester head. The feed rolls press against the trunk and pull the stem therethrough.

The vehicle may be a wheeled or tracked vehicle. The harvester vehicle includes an engine for providing power to the operating systems of the vehicle including the electrical and hydraulic systems thereof.

What is needed in the art is an efficient way of increasing torque to the motors of the harvester head.

SUMMARY OF THE INVENTION

The invention one form is directed to a ground engaging work vehicle including a frame, a plurality of tractive elements, a movable extension, a hydraulic fluid using attachment, a hydraulic fluid pump and an accumulator. The plurality of tractive elements are coupled to the frame. The tractive elements engage the ground. The movable extension is connected to the frame. The hydraulic fluid using attachment is coupled to the movable extension. The hydraulic fluid pump is selectively fluidly coupled to the attachment. The accumulator is selectively fluidly coupled to the attachment dependent upon at least one fluid flow requirement of the attachment.

The invention in another form is directed to a hydraulic system associated with a ground engaging work vehicle. The system includes a hydraulically driven attachment, a hydraulic fluid pump, and an accumulator. The hydraulic fluid pump is selectively fluidly coupled to the attachment. The accumulator is selectively fluidly coupled to the attachment dependent upon at least one fluid flow requirement of the attachment.

DETAILED DESCRIPTION OF THE INVENTION

Figure 1:
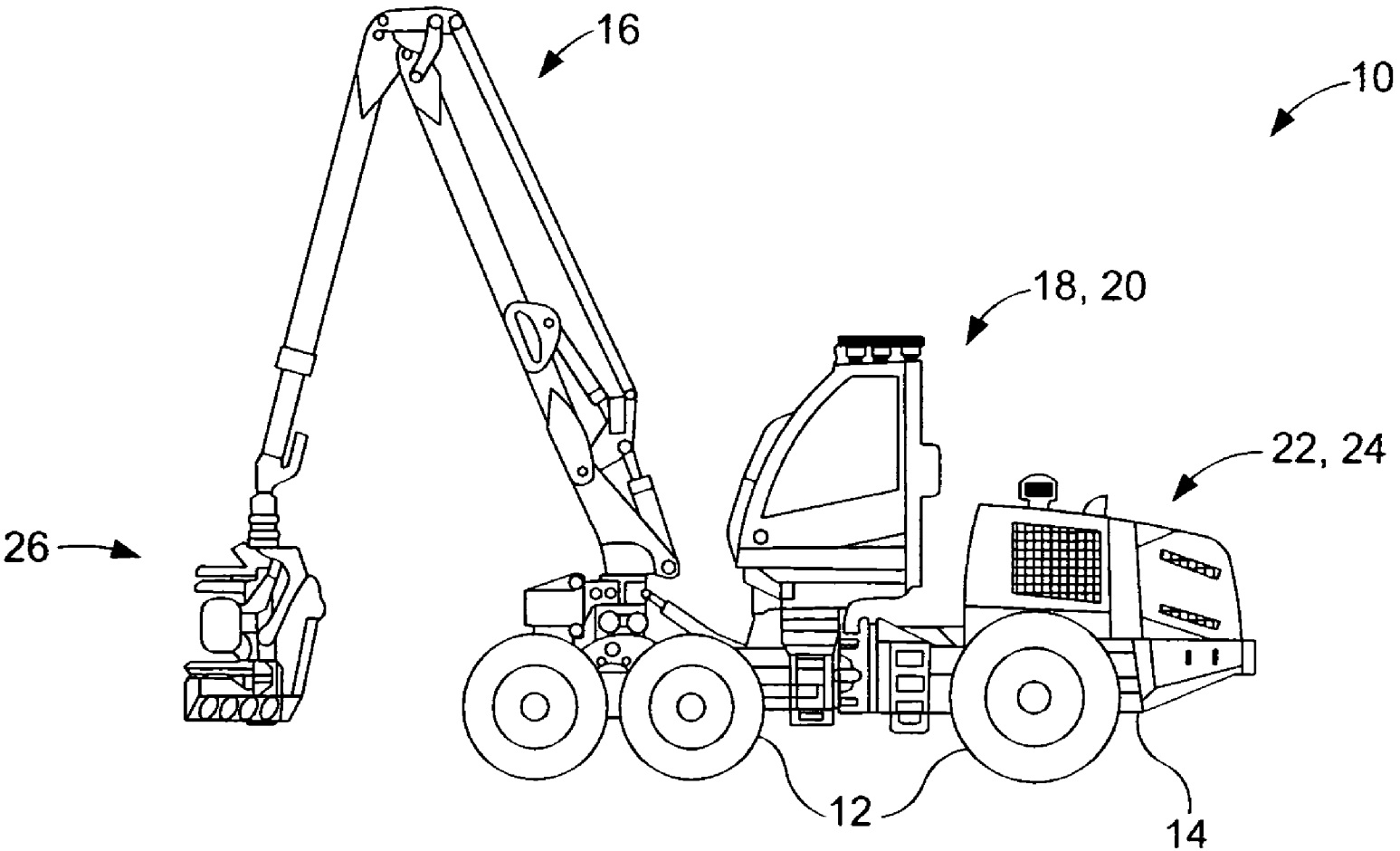
FIG. 1 is an illustrative vehicle utilizing an embodiment of a hydraulic system of the present invention.

Referring now to FIG. 1, there is shown a work vehicle 10 including wheels 12, a frame 14, an articulated arm 16, a cab

18 containing controls 20, an engine 22 and a hydraulic system 24 driven by engine 22. Work vehicle 10 may be in the form of a harvester for use in a forest environment. Work vehicle 10 is driven by wheels 12 that are coupled to frame 14. Wheels 12 are also known as tractive elements 12, which are depicted here as wheels, yet it is understood that other tractive devices such as tracks may also be used. Articulated arm 16 also known as a movable extension of work vehicle 10 is connected in a movable fashion with frame 14.

An operator sits in cab 18 having access to controls 20 to direct the power of engine 22 and the application of hydraulic fluid from hydraulic system 24. Attachment 26, which is also known as a harvester head 26, is connected to an end of articulated arm 16 and is disposed in a controllable manner about a tree trunk, also known as a tree stem, for the harvesting and processing of a tree.

Figure 2:
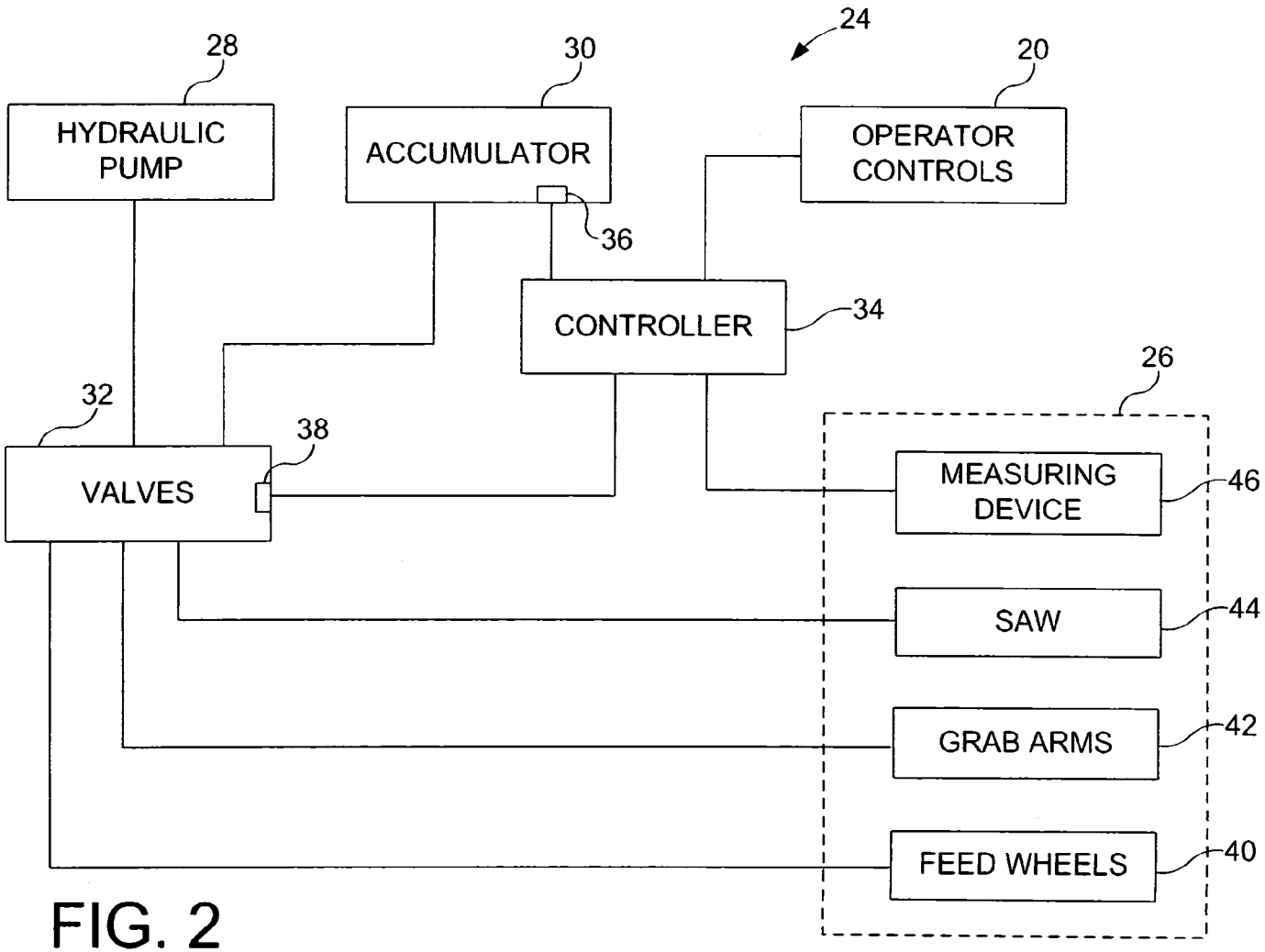
FIG. 2 is a schematical block diagram illustrating the hydraulic system of FIG. 1.

Now, additionally referring to FIG. 2 there is illustrated, in a schematic form, elements of work vehicle 10, more specifically hydraulic system 24 and attachment 26. Hydraulic system 24 includes a hydraulic pump 28, an accumulator 30, valves 32, a controller 34, a sensor 36 and a sensor 38. Attachment 26 also known as a harvester head 26 or tree processor 26 includes feed wheels 40, grab arms 42, a saw 44 and a measuring device 46.

An operator provides instructions by way of operator controls 20 from cab 18 which are interpreted by controller 34, which is herein illustrated as a separate stand alone controller, however functions thereof may be included in another controller, typically found on a work vehicle 10, such as an electronic control unit or even as standalone circuitry. The elements of controller 34 may be carried out by a combination of firmware, software and hardware. Hydraulic pump 28 is hydraulically coupled to valves 32, which provide a distribution of hydraulic fluid to feed wheels 40, grab arms 42 and saw 44. While only a single line is illustrated in FIG. 2 proceeding from valves 32 to feed wheels 40, grab arms 42 and saw 44, it is recognized that more than one hydraulic line may run to each to control different aspects of those items and to provide return flow of the hydraulic fluid. For example, feed wheels 40 may be movable by a hydraulic cylinder, also known as a hydraulic actuator and feed wheels 40 may be rotated with a hydraulic motor for the driving of feed wheels. In a similar fashion saw 44 can have one hydraulic line to provide fluid to the hydraulic motor powering saw 44 as well as fluid to a hydraulic actuator that moves saw 44 so that it engages the stem of the tree to cut the stem at a selected point.

In a preferred embodiment of the present invention controller 34 receives a signal from operator controls 20 to initiate an action with at least one part of attachment 26, such as feed wheels 40. Controller 34 sends a signal to valves 32 to cause hydraulic flow to be initiated to feed wheels 40. The hydraulic flow will cause a hydraulic motor that drives feed wheels 40 to rotate thereby moving the stem of a tree through harvester head 26. To move the stem there is a need for sufficient energy to overcome the inertia of the tree, the drag of limbs on the ground as well as limbs encountering delimbing blades. Controller 34 directs the flow of hydraulic fluid to feed wheels 40 from hydraulic pump 28 and accumulator 30 in a coordinated manner. The fluid flow can be substantially simultaneously supplied from these two sources, or the flow from one of the sources can be delayed relative to the other, as directed by controller 34. The fluid flow requirement to move wheels 40 can be assumed to be greatest when movement is initiated. Additionally, since measuring device 46 provides positional information and controller 34 would include timing information, the movement of the stem of the tree can be monitored and controller 34 can selectively couple accumulator 30 to the motors of wheels 40 if the stem slows below a predicted or predetermined speed.

Since accumulator 30 stores pressurized fluid the flow from accumulator 30 will dissipate over time as it flows to an element of harvester head 26, and the valve associated with the flow therefrom can then be closed. When fluid flow from hydraulic pump 28 is not being directed elsewhere, controller 34 directs fluid therefrom to accumulator 30 to recharge accumulator 30.

For ease of understanding, system 24 can be considered a passive system without the use of sensors, with accumulator 30 being charged from hydraulic pump 28 whenever flow is not being directed elsewhere by valves 32. Then a contribution of fluid flow is initiated from accumulator 30 when particular elements are activated, such as when feed wheels 40 are activated. The advantages of this embodiment are discussed below along with those of an alternative embodiment.

In an alternative embodiment of the present invention sensors are used to provide further information to controller 34, such as sensor 36 measures the pressure of hydraulic fluid in accumulator 30 and sensor 38 measures flow rates of hydraulic fluid to the elements of attachment 26. The information from sensors 36 and 38 are utilized by controller 34, along with other inputs, to select a time for activating a valve 32 so that pressure from accumulator 30 adds to the hydraulic flow volume and/or pressure coming from hydraulic pump 28 and is sent to a particular element of attachment 26 by way of control signals from controller 34 to valves 32. The selection of timing and duration of the release of fluid from accumulator 30 is undertaken to supplement power available from hydraulic pump 28. The varying demands for hydraulic flow for the use of attachment 26 allow controller 34 to selectively use valves 32 to direct pressurized fluid in the system. For example, fluid from hydraulic pump 28 can be used to directly or by way of a hydraulic transformer to increase the pressure in accumulator 30 during times when elements of attachment 26 are not being utilized or the utilization is of an acceptably low volume to allow some of the volume from hydraulic pump 28 to be utilized in accumulating pressurized hydraulic fluid in accumulator 30.

When an operator provides the controlling instructions to controller 34 to activate functions of attachment 26, controller 34 in selective use of valves 32 can direct flow from hydraulic pump 28 and utilize pressure from accumulator 30 in anticipation of a load that may be encountered by an element of attachment 26. For example, if saw 44 is going to be powered up, extra hydraulic fluid from accumulator 30 may be released to overcome the starting momentum used to power up saw 44. In another example, when the stem of a tree is currently in position in harvester head 26 and feed wheels 40 are going to be activated, in anticipation of the fluid flow demand due to the starting of the movement of the substantial mass of the tree stem, which may be compounded by portions of the tree dragging along the ground and when limbs on the tree come against blades which are a part of harvester head 26. These elements can vary the load as the stem is being processed causing controller 34 to, at various times, supplement the flow of hydraulic fluid to feed wheels 40 by providing a flow from accumulator 30.

Figure 3:
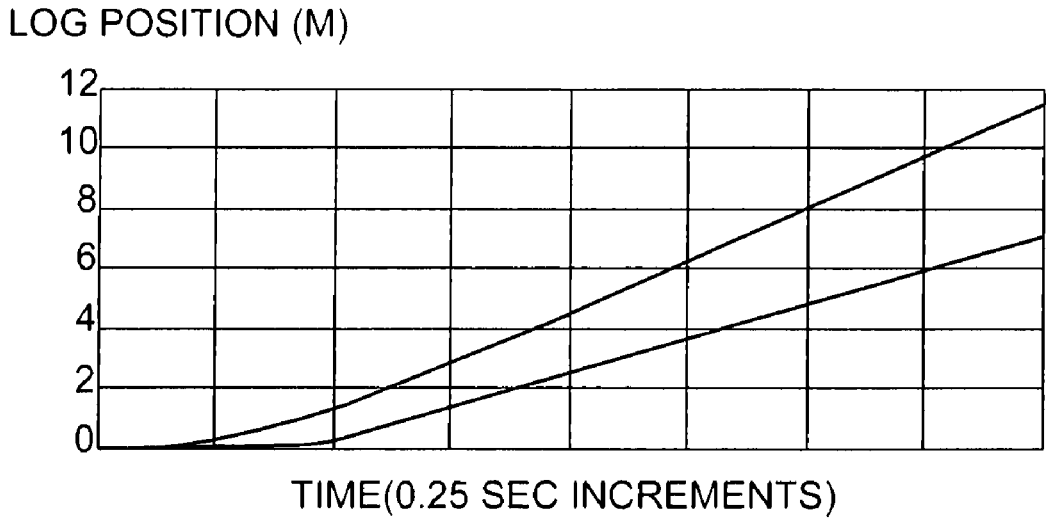
FIG. 3 is a chart illustrating some of the advantages of the present invention of FIGS. 1 and 2.
Figure 4:
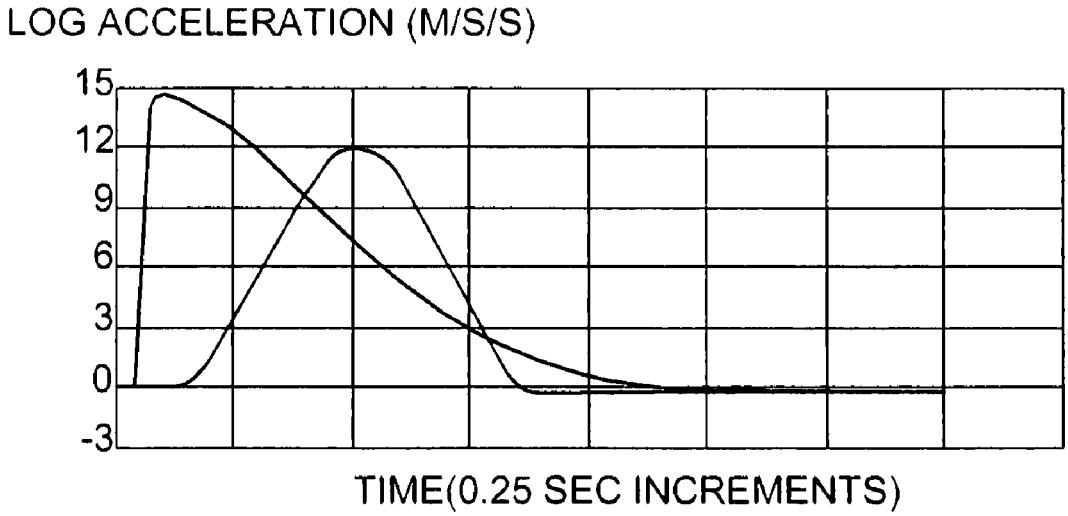
FIG. 4 is another chart illustrating further advantages of the invention depicted in FIGS. 1 and 2.

Now, additionally referring to FIGS. 3 and 4, there are illustrated some of the functional advantages of the embodiments of the present invention. In FIG. 3 there are two curves with the lower curve showing the movement of the stem of a log through harvester head 26 in quarter second increments with a harvester head 26 without the advantage of the present invention. The upper curve illustrates the log position, hence movement of the log at a faster rate over the same time period utilizing the additional flow from accumulator 30 on a selective basis under the control of controller 34.

FIG. 4 illustrates the acceleration of a log through harvester head 26 and how the acceleration occurs in a much quicker time frame, as illustrated by the curve that peaks further to the left. The curve peaking to the right illustrating the function of harvester head 26 without the advantage of the present invention. The dynamic control of the movement of a log through harvester head 26 improves the throughput of trees due to the present invention.

While FIG. 2 illustrates attachment 26 as being separate from the other elements of hydraulic system 24, it is to be understood that these elements can be utilized having their position upon attachment 26 or elsewhere on work vehicle 10 without altering the functionality of the present invention. For example, accumulator 30 may exist as a part of harvester head 26 or located elsewhere on vehicle 10.

Information from measuring device 46 can be utilized by controller 34 as an input to show the movement of a stem through harvester head 26 so that controller 34 can selectively release fluid from accumulator 30 in the event the stem slows down, for example when a limb on the log encounters a cutting blade. The fluid flows utilized by the hydraulic motors associated with feed wheels 40, grab arms 42 and saw 44 can also be utilized as an indication of a need to send additional fluid flow from accumulator 30. The signal from measuring device 46 includes information on the position of the log, which can then be utilized by controller 34 along with a time stamp measurement associated with the positioning of the log to calculate the acceleration and movement velocity of the log through the system to additionally allow controller 34 to selectively apply or disengage its supply of fluid from accumulator 30.

In the event accumulator 30 is located on harvester head 26, valves to control the fluid flow from accumulator 30 would be located thereon. In the illustrated reference in FIG. 2 the use of a single rectangular block to denote valves 32 does not constrain the positioning of the valves to a single location, nor does any of the schematical blocks constrain the location of the particular element or distributed location of multiple elements that may be a part of that particular block.

The present invention uses accumulator 30 to store hydraulic fluid at high pressure for use by harvester head 26 as needed to supplement the normal hydraulic fluid flow from hydraulic pump 28. The additional flow from accumulator 30 is used to provide the high volume oil demanded by harvester head 26 during certain operations including the log feeding, previously discussed, as well as cross-cutting of the log by way of saw 44. Accumulator 30 is supplied with oil by hydraulic pump 28 during times when the maximum hydraulic pump capacity is not required for use by harvester head 26 or other elements of work vehicle 10. This advantageously allows high oil flow volumes when needed without requiring the machine to be oversized in regard to a higher horsepower engine or an oversized hydraulic pump. This provides for lower initial cost of components as well as overall operating cost during operation, which increases the engine efficiency, such as the ability to run at a lower horse power without sacrificing head productivity while also reducing heat dissipation requirements of the system.

Having described the preferred embodiment, it will become apparent that various modifications can be made without departing from the scope of the invention as defined in the accompanying claims.

The invention claimed is:

1. A ground engaging work vehicle, comprising:

a frame;

a plurality of tractive elements coupled to said frame, said tractive elements engaging the ground;

a movable extension connected to said frame;

a hydraulic fluid using attachment coupled to said movable extension;

a hydraulic fluid pump selectively fluidly coupled to said attachment; and an accumulator selectively fluidly coupled to said attachment dependent upon at least one fluid flow requirement of said attachment;

a plurality of sensors including a pressure sensor coupled to said accumulator and a flow sensor coupled to a hydraulic flow between said pump and said attachment; and a controller configured to receive information from said pressure sensor and said flow sensor, said controller being further configured to select a timing and duration of release of fluid from said accumulator to said attachment dependent upon said information, and being configured to substantially simultaneously initiate a fluid flow from both the accumulator and the pump to the attachment.

2. The ground engaging work vehicle of claim 1, wherein said attachment includes at least one hydraulic actuator and at least one hydraulic motor.

3. The ground engaging work vehicle of claim 2, further comprising:

a plurality of valves in fluid communication with said hydraulic fluid pump, said accumulator and said attachment; and a controller in controllable communication with said plurality of valves, said attachment including a plurality of feed wheels including a first feed wheel configured to move a stem of a tree through said attachment, said at least one hydraulic motor including a first hydraulic motor drivingly coupled to said first feed wheel.

4. The ground engaging work vehicle of claim 3, wherein said attachment additionally includes a saw, said at least one hydraulic motor including a second hydraulic motor drivingly coupled with said saw, said controller configured to apply said fluid from said accumulator to said second hydraulic motor.

5. The ground engaging work vehicle of claim 3, wherein said attachment additionally includes a plurality of grab arms which are movable by way of said at least one hydraulic actuator, said controller configured to apply said fluid from said accumulator and said hydraulic fluid pump to said at least one hydraulic actuator when said at least one hydraulic actuator is actuated.

6. The ground engaging work vehicle of claim 3, wherein said plurality of feed wheels additionally includes a second feed wheel, said at least one hydraulic motor including a second hydraulic motor associated with said second feed wheel, said first feed wheel and said second feed wheel configured to pull the stem of the tree through said attachment with the stem being located between said first feed wheel and said second feed wheel, the stem defining a substantial mass, said controller configured to apply said fluid from said hydraulic fluid pump and said accumulator to at least one of said first hydraulic motor and said second hydraulic motor.

7. The ground engaging work vehicle of claim 6, wherein said attachment includes a measuring device communicatively coupled to said controller, said measuring device sending a signal representative of a length of the stem that has been moved through said attachment by said plurality of feed wheels.

8. The ground engaging work vehicle of claim 7, wherein said controller is configured to use said signal to compute at least one of a velocity and an acceleration of the substantial mass, said controller being further configured to direct fluid from said accumulator to at least one of said first hydraulic motor and said second hydraulic motor if one of said velocity and said acceleration is below a predetermined amount.

9. The ground engaging work vehicle of claim 1, wherein the vehicle is in the form of a tree harvester.

10. A hydraulic system associated with a ground engaging work vehicle, the system comprising:

a hydraulically driven attachment;

a hydraulic fluid pump selectively fluidly coupled to said attachment; and an accumulator selectively fluidly coupled to said attachment dependent upon at least one fluid flow requirement of the attachment;

a plurality of sensors including a pressure sensor coupled to said accumulator and a flow sensor coupled to a hydraulic flow between said pump and the attachment; and a controller configured to receive information from said pressure sensor and said flow sensor, said controller being further configured to select a timing and duration of release of fluid from said accumulator to said attachment dependent upon said information, and being configured to substantially simultaneously initiate a fluid flow from both the accumulator and the pump to the attachment.

11. The system of claim 10, wherein the attachment includes:

at least one hydraulic actuator; and at least one hydraulic motor.

12. The system of claim 11, further comprising:

a plurality of valves in fluid communication with said hydraulic fluid pump, said accumulator and said attachment; and a controller in controllable communication with said plurality of valves, said attachment including a plurality of feed wheels including a first feed wheel configured to move a stem of a tree through said attachment, said at least one hydraulic motor including a first hydraulic motor drivingly coupled to said first feed wheel.

13. The system of claim 12, wherein said attachment additionally includes a saw, said at least one hydraulic motor including a second hydraulic motor drivingly coupled with said saw, said controller configured to apply said fluid from said hydraulic fluid pump and said accumulator to said second hydraulic motor.

14. The system of claim 12, wherein said attachment additionally includes a plurality of grab arms which are movable by way of said at least one hydraulic actuator, said controller configured to fluidly couple said hydraulic fluid pump and said accumulator to said at least one hydraulic actuator.

15. The system of claim 12, wherein said plurality of feed wheels additionally includes a second feed wheel, said at least one hydraulic motor including a second hydraulic motor associated with said second feed wheel, said first feed wheel and said second feed wheel configured to pull the stem of the tree through said attachment with the stem being located between said first feed wheel and said second feed wheel, the stem defining a substantial mass, said controller configured to detect a characteristic of movement of the substantial mass and apply said fluid from said accumulator to at least one of said first hydraulic motor and said second hydraulic motor dependent on said characteristic.

16. The system of claim 15, wherein said attachment includes a measuring device communicatively coupled to said controller, said measuring device sending a signal representative of a length of the stem that has been moved through said attachment by said plurality of feed wheels.

17. The system of claim 16, wherein said controller is configured to use said signal to compute an acceleration of the substantial mass, the acceleration being said characteristic.

18. The system of claim 10, wherein the vehicle is a tree harvester.

* * * * *